US012061029B2

(12) United States Patent
Vargas

(10) Patent No.: US 12,061,029 B2
(45) Date of Patent: Aug. 13, 2024

(54) REFRIGERATOR APPLIANCE WITH HIGH FREEZER CAPACITY

(71) Applicant: ELECTROLUX APPLIANCES AKTIEBOLAG, Stockholm (SE)

(72) Inventor: Mario Vargas, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 188 days.

(21) Appl. No.: 17/763,269

(22) PCT Filed: Oct. 1, 2019

(86) PCT No.: PCT/EP2019/076527
§ 371 (c)(1),
(2) Date: Mar. 24, 2022

(87) PCT Pub. No.: WO2021/063485
PCT Pub. Date: Apr. 8, 2021

(65) Prior Publication Data

US 2022/0333838 A1 Oct. 20, 2022

(51) Int. Cl.
*F25B 49/02* (2006.01)

(52) U.S. Cl.
CPC .... *F25B 49/022* (2013.01); *F25B 2600/0253* (2013.01)

(58) Field of Classification Search
CPC ..... F25B 49/022; F25B 2600/0253
See application file for complete search history.

(56) References Cited

U.S. PATENT DOCUMENTS

2007/0012055 A1 1/2007 Schenk et al.
2011/0302939 A1 12/2011 Rockenfeller et al.
2014/0165632 A1* 6/2014 Abbasi ..... F25D 29/00 62/89

FOREIGN PATENT DOCUMENTS

CN 106123441 11/2016
JP 2002022336 A * 1/2002

OTHER PUBLICATIONS

Imakubi, Refrigerator, 2000, Full Document (Year: 2000).*

(Continued)

*Primary Examiner* — Nael N Babaa
(74) *Attorney, Agent, or Firm* — Pearne & Gordon LLP

(57) ABSTRACT

A refrigeration appliance (2) is provided. The refrigeration appliance can comprise a fresh-food compartment (7) configured for storing food items at a first target temperature above zero degrees Celsius; and a freezer compartment (11) configured for storing food items at a second target temperature below zero degrees Celsius. A cooling air channel (27) is formed between the freezer compartment and the fresh-food compartment to allow air to flow between the freezer compartment and the fresh-food compartment. The refrigeration appliance further comprises a refrigeration circuit configured for cooling the freezer compartment, the circuit having a compressor, in particular a variable speed compressor, an evaporator, and a variable speed evaporator fan. A controller is operatively connected to the refrigeration circuit and configured to operate the variable speed compressor and/or the variable speed evaporator fan at a calculated speed of the variable speed compressor and a calculated speed of the variable speed evaporator fan, respectively; wherein the controller is configured to, in a normal mode of operation, operate the variable speed compressor at a first calculated compressor speed and the variable speed evaporator fan at a first calculated fan speed and wherein the controller is configured to, in a freezer priority, mode of operation, operate the variable speed compressor at a second calculated compressor speed and the variable speed evaporator fan at a second calculated fan speed, wherein the second calculated compressor speed is higher than the first calculated compressor speed and the second calculated fan speed is lower than the first calculated fan speed. Hereby an efficient control of the refrigeration (Continued)

appliance can be obtained wherein a quick-freezing mode can be supported that gives priority to the freezer in an efficient manner. Hereby items placed in the freezer compartment can be quickly frozen in an energy efficient manner.

11 Claims, 4 Drawing Sheets

(56) References Cited

OTHER PUBLICATIONS

International Search Report for PCT/EP2019/076527 dated Jun. 16, 2020, 2 pages.
Intention to Grant in related European application No. 19783253.8, dated Apr. 29, 2024, 30 pages.

* cited by examiner

REFRIGERATOR APPLIANCE WITH HIGH FREEZER CAPACITY

TECHNICAL FIELD

The invention relates to a refrigeration appliance. In particular, the present invention relates to a refrigeration appliance having a fresh-food compartment configured for storing food items at a first target temperature above zero degrees Celsius; and a freezer compartment configured for storing food items at a second target temperature below zero degrees Celsius.

BACKGROUND

Conventional refrigeration appliances, such as domestic refrigerators, typically have both a fresh-food compartment and a freezer compartment or section. The fresh-food compartment is where food items such as fruits, vegetables, and beverages are stored and the freezer compartment is where food items that are to be kept in a frozen condition are stored. A typical refrigerator includes a freezer compartment that operates at a temperature below freezing and a fresh-food compartment that operates at a temperature between the ambient temperature (that is, the temperature in the space outside the refrigerator cabinet) and freezing. The refrigerators are provided with a cooling/refrigeration system for the purpose of generating and dispersing cold air into the refrigeration cavities. The refrigeration system typically maintains the fresh-food compartment at temperatures around and above 0° C., such as between 2° C. and 10° C. and the freezer compartments at a lower temperature such typically temperatures below 0° C., such as between 0° C. and −20° C. The refrigeration system can include a standard compressor or a variable speed compressor (VSC), a condenser, a condenser fan, an evaporator connected in series and charged with a refrigerant, and an evaporator fan. The evaporator fan circulates cooling air through the refrigerator compartments and improves heat transfer efficiency.

Cooling air can be split, channeled, ducted, and then delivered into the freezer compartment to establish a freezer compartment temperature with a portion of the cooling air further directed to the fresh-food compartment to maintain a desired fresh-food compartment temperature. Cooling air is guided through a passageway (e.g., a cooling air channel or air duct) that is in fluid communication with the cooling system and both the freezer and the fresh-food compartments. A damper or baffle can be arranged within the passageway to selectively allow cooling air to pass into one, the other, or both of the freezer and the fresh-food compartments.

The refrigerators can include an electronic control system to control the refrigeration components, such as the compressor, condenser, evaporator, etc. The control system can use several factors, such as temperature of the freezer and fresh-food compartments, the ambient temperature, upper and lower temperature limits, etc., to vary parameters of the refrigeration components, such as turning on and off the compressor, or the speeds of the compressor, the condenser fan, and the evaporator fan, for example. Temperature sensors can be provided inside and outside the refrigerator to measure the temperature inside the freezer and fresh-food compartments, as well as the ambient temperature.

Some multi-compartment refrigerators have only one automatically controlled compartment (e.g., a "master"), while the other compartments are designated as dependent or "slaves". In some arrangements, the temperature in the slave compartments is adjusted by moving manually a mechanical damper or baffle that distributes the air to the compartments. Efforts to use a variable speed compressor (VSC) in an appliance with a manual damper (or no damper) are currently limited to narrow speed ranges, which reduces the potential benefits of a VSC in terms of energy consumption. For example, it is difficult to apply a VSC to single circuit systems with mechanical dampers as it will not compensate for ambient temperature changes. Because the change in speed affects the temperature balance among the compartments, temperature control of the "slave" compartment usually requires user actions to adjust the damper position, which results in a poor user experience.

Another solution is to use an automatic damper, which increases cost. Therefore, it is desirable to provide an energy-efficient temperature control method that addresses these problems.

Further, US20140165632 describes a method of operation a refrigeration system comprising a variable speed evaporator fan. The method comprising the steps of providing a set point temperature for the fresh food compartment and for the freezer compartment. The temperature of the fresh food compartment and the freezer compartment are measured. The fresh food compartment temperature error and the freezer food compartment temperature error are determined and both error temperatures are then use to determine the respective compartment demand for cold air. The speed of a fan can then be set accordingly.

There is a constant desire to improve refrigeration appliances. Hence, there exists a need for an improved refrigeration appliance.

SUMMARY

It is an object of the present invention to provide an improved refrigeration appliance.

These objects and or others are obtained by a refrigeration appliance as set out in the appended claims.

In accordance with the invention a refrigeration appliance is provided. The refrigeration appliance can comprise a fresh-food compartment configured for storing food items at a first target temperature above zero degrees Celsius; and a freezer compartment configured for storing food items at a second target temperature below zero degrees Celsius. A cooling air channel is formed between the freezer compartment and the fresh-food compartment to allow air to flow between the freezer compartment and the fresh-food compartment. The refrigeration appliance further comprises a refrigeration circuit configured for cooling the freezer compartment, the circuit having a compressor, in particular a variable speed compressor, an evaporator, and a variable speed evaporator fan. A controller is operatively connected to the refrigeration circuit and configured to operate the variable speed compressor and/or the variable speed evaporator fan at a calculated speed of the variable speed compressor and a calculated speed of the variable speed evaporator fan, respectively; wherein the controller is configured to, in a normal mode of operation, operate the variable speed compressor at a first calculated compressor speed and the variable speed evaporator fan at a first calculated fan speed and wherein the controller is configured to, in a freezer priority, mode of operation, operate the variable speed compressor at a second calculated compressor speed and the variable speed evaporator fan at a second calculated fan speed, wherein the second calculated compressor speed is higher than the first calculated compressor speed and the second calculated fan speed is lower than the first calculated fan speed. Hereby an efficient control of the refrigeration appliance can be obtained wherein a quick-freezing mode can be supported that gives priority to the freezer in an efficient manner. Hereby items placed in the freezer compartment can be quickly frozen in an energy efficient manner.

In accordance with one embodiment a manually operated control button configured to switch between the controller to operating in said normal mode of operation and said freezer priority mode of operation is provided. Hereby an easy to implement and use control of the setting for the freezer priority mode can be obtained.

In accordance with one embodiment a manually operated baffle in said cooling air channel. Hereby the control of air in the cooling air-channel can be controlled in a manner that is cost-efficient to implement.

In accordance with one embodiment a defrost evaporator temperature sensor is provided, and wherein the controller is configured to automatically exit the freezer priority mode when the defrost evaporator temperature sensor indicates a temperature below a pre-set temperature. Hereby the defrost temperature sensor can be used to provide an input signal that indicates when the goods placed in the freezer compartment has reached a temperature where a freezer priority mode is no longer required.

In accordance with one embodiment a timer is provided and wherein the controller is configured to automatically exit the freezer priority mode when the timer indicates that the indicates freezer priority mode has been operational for a pre-set time. Hereby the freezer priority mode can be exited based on a timer to not let the freezer priority mode be enabled for a too long time period.

In accordance with one embodiment, the controller is configured to upon exiting the freezer priority mode of operation, return to the normal mode of operation. Hereby, a simple to implement control algorithm can be obtained.

In accordance with one embodiment, in the freezer priority mode, the fan speed is controlled to keep the temperature of the Fresh Food compartment closer to a temperature set point than in the normal mode of operation. Hereby the evaporator fan speed will be reduced when the temperature gets closer to the set point so it will take longer to cool down the refrigeration. This means the compressor operation duration increases so a larger cooling capacity is available to the freezer, thereby enabling a quick reduction of the temperature in the freezer compartment.

In accordance with one embodiment, where, in the freezer priority mode, the fan speed is calculated through a PID (Proportional, Integral and derivative) control algorithm based on the temperature error defined as the difference between Fresh Food temperature sensor and the temperature set point. Hereby a precise and stable control of the Fresh Food avoiding unnecessary compressor cycling.

In accordance with one embodiment, where, in the freezer priority mode, the minimum variable speed compressor is set to a, typically high speed, pre-determined value. This can be advantageous because high freezing capacity requires high compressor speed. Once the Fan speed is used to bring the Fresh Food closer to the set point, the compressor speed may not increase. Then the compressor can be forced to a predetermined, higher, speed so the desired larger cooling capacity is available.

In accordance with one embodiment, the compressor speed is configured to be set to the maximum speed of the compressor speed determined by the normal mode and the Freezer Priority pre-determined value. Thus, assuming there are at least two modes of operation: Normal mode of operation and Freezing Priority mode. In case the compressor is forced to a high speed of operation selected in the Freezing priority mode is not the maximum speed available (for example, for noise or energy optimization reasons) and there is cooling need (assuming that the evaporator fan is already operating in maximum speed), then the Normal Mode compressor speed calculation can be used (whenever higher than the Freezer Priority mode).

In accordance with one embodiment, where, in the freezer priority mode, the set point temperature of the fresh food compartment is configured to be set to a lower temperature than in the normal mode of operation. This can give an extra freezing capacity as a colder fresh food compartment will require a longer compressor run time.

BRIEF DESCRIPTION OF THE DRAWINGS

The invention will now be described in more detail, by way of example, and with reference to the accompanying drawings, in which.

DETAILED DESCRIPTION

The invention will now be described more fully hereinafter with reference to the accompanying drawings, in which certain embodiments of the invention are shown. The invention may, however, be embodied in many different forms and should not be construed as limited to the embodiments set forth herein; rather, these embodiments are provided by way of example so that this disclosure will be thorough and complete, and will fully convey the scope of the invention to those skilled in the art. For example, like or similar components of different embodiments can be exchanged between different embodiments. Some components can be omitted from different embodiments. Like numbers refer to like elements throughout the description.

Figure 1:
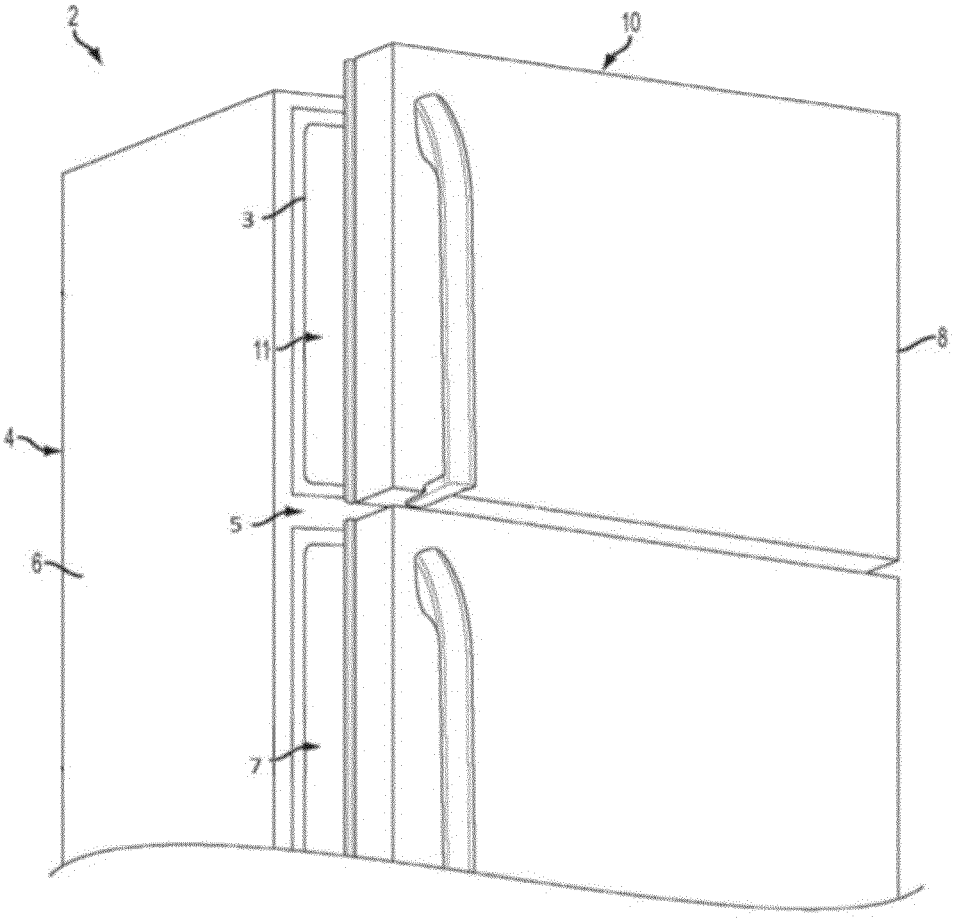
FIG. 1 shows an insulated cabinet of a refrigeration appliance.

FIG. 1 shows an insulated cabinet of a refrigeration appliance constructed invention generally indicated at 2. The cabinet 2 includes a cabinet shell 4 defined at least in part by first and second upstanding side panels 6 and 8 that are interconnected and laterally spaced by a top panel 10. Although not shown in this figure, cabinet shell 4 would also include a rear panel and internal reinforcing structure. A liner 3 inside the shell can define spaces. Foam insulation may be used between the cabinet shell 4 and the liner 3. Since the refrigerator cabinet 2 represents a top mount-type refrigerator (i.e., including a freezer compartment 11 located above the fresh-food compartment 7), a divider portion 5 is provided which extends laterally across shell 4 and divides refrigerator cabinet 2 into an upper space that can be used as a freezer compartment 11, and a lower space that can be used as a fresh-food compartment 7.

The refrigerator 2 shown in FIG. 1 is one possible example of a refrigerator 2. For example, the refrigerator shown and described herein is a so-called top mount-type refrigerator with the freezer compartment 11 located above the fresh-food compartment 7. However, in some cases, the refrigerator can have a freezer compartment located below the fresh-food compartment (i.e., a bottom mount refrigerator), a side-by-side configuration of a refrigerator with a fresh-food compartment and a freezer compartment, a stand-alone refrigerator or freezer, etc. In further examples, the refrigerator 2 could be provided with multiple compartments or with compartments located above and/or laterally with respect to one another. Whatever arrangement of the freezer compartment and the fresh-food compartment is employed, typically, separate access doors are provided for the refrigerated compartments so that either compartment may be accessed without exposing the other compartment to the ambient air. For example, a door provides access to the freezer compartment, and a door provides access to the fresh-food compartment of the refrigerator. Although the embodiments described in detail below, and shown in the figures concern a top mount-type refrigerator, the refrigerator can have any desired configuration including at least one compartment for storing food items, at least one door for closing the compartment(s), and a condenser/cooling system configured to remove heat energy from the compartment(s) to the outside environment, without departing from the scope of the present invention. Accordingly, it is to be appreciated that the refrigerator 2 shown in FIG. 1 comprises only one possible example, as any number of designs and configurations are contemplated.

Turning to the shown example of FIG. 1, the freezer compartment 11 includes a freezer compartment door 9 and the fresh-food compartment 7 includes a fresh-food compartment door 12. Both the fresh-food compartment 7 and the freezer compartment 11 define substantially hollow interior portions and may include shelves, drawers, or the like.

A cooling air channel or air duct can be formed between the freezer 11 and fresh-food 7 compartments to allow air flow between the two compartments 7, 11. In one embodiment, the cooling air channel can be a fixed cooling air channel formed with specific fixed dimensions that do not vary during the operation of the refrigerator 2. In certain embodiments, the dimensions of the cooling air channel between the freezer 11 and fresh-food 7 compartments can be controlled by a manual damper configured to be operated by the user.

Figure 2:
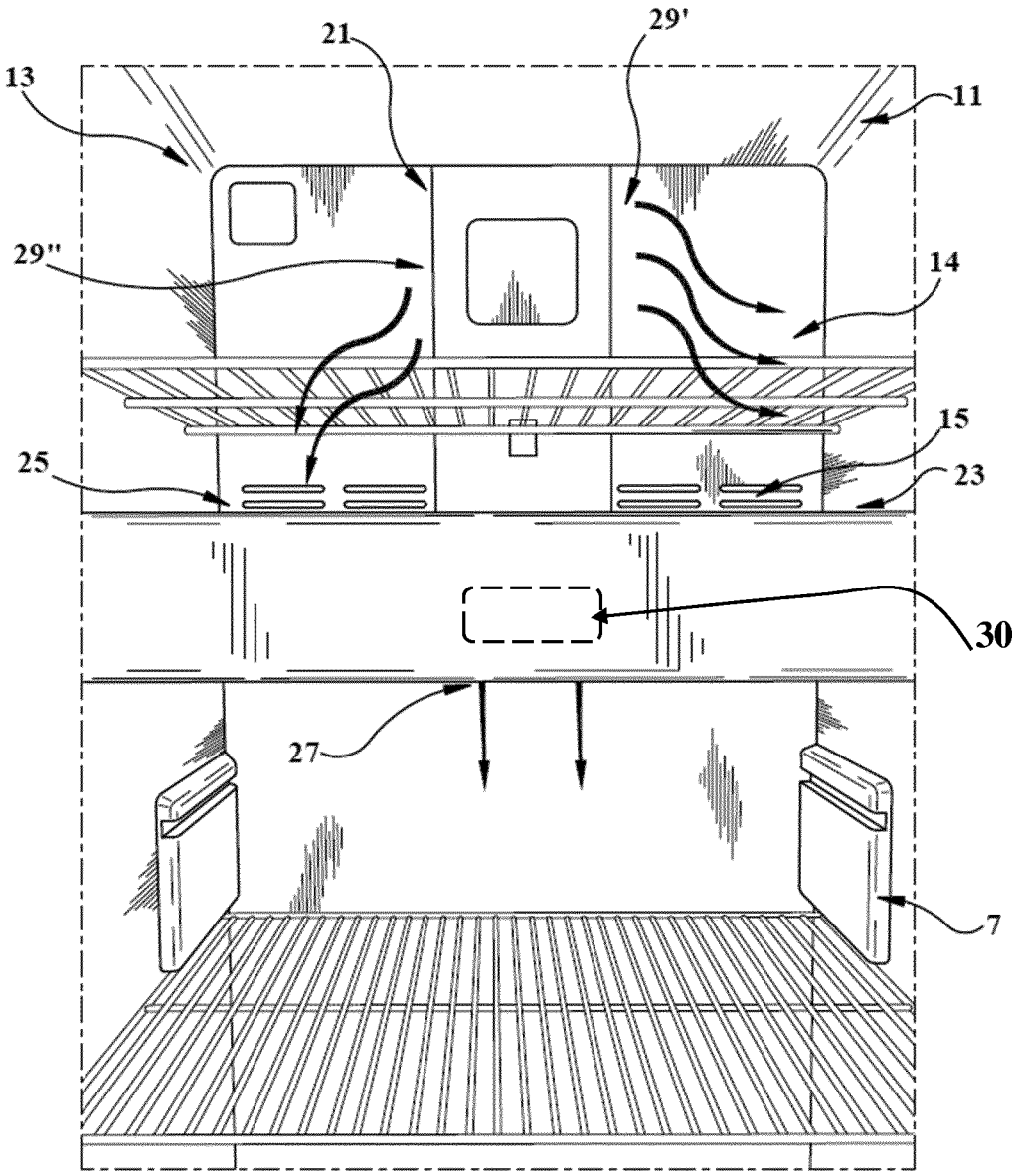
FIG. 2 shows the interior of a freezer compartment and a fresh-food compartment of a refrigerator.

FIG. 2 shows the interior of the freezer compartment 11 and the fresh-food compartment 7 of the refrigerator 2. The interior of the freezer compartment 11 can include an air tower 21 secured to the back of the freezer compartment 11 to the rear wall 13 of the liner 3, facing the interior of the freezer compartment 11. In one embodiment, the air tower 21 may be attached to the lower center area of an evaporator cover 14. The evaporator coil cover 14 can be coupled to the rear liner 13 by any suitable mechanical (e.g., screws, rivets, nuts and bolts, etc.), chemical (e.g., adhesive, epoxy, etc.), or other type of fastener. Vents 15 are provided in a lower portion of the evaporator coil cover 14 that allow a circulation of air pulled by the evaporator fan (shown in FIG. 3) through the evaporator. Although the example of FIG. 2 shows the evaporator coil cover 14 in the freezer compartment 11, it is contemplated that the evaporator coil cover 14 can be located inside the fresh-food compartment 7, in between the freezer compartment 11 and the fresh-food compartment 7 or even externally forming an evaporator compartment, without departing from the scope of the present invention.

The air tower 21 serves to distribute cool air discharged from the evaporator fan (shown in FIG. 3) throughout the freezer compartment 11 and the fresh-food compartment 7 of the refrigerator 2. In one embodiment, the bottom edge of the air tower 21 is insertable into a foamed-in air duct that is in fluid communication with the fresh-food compartment 7 of the refrigerator 2, so to permit the air tower 21 to provide cool air discharged from the evaporator fan to the fresh-food compartment 7. Vents can be disposed on top and upper sides of the air tower 21 to distribute cool air to the freezer compartment 11. Vents can also be disposed on the lower sides of the air tower 21 to return air from the freezer compartment 11 to the air tower 21 for recirculation.

As is further illustrated in FIG. 2, the bottom of the freezer compartment 11 includes a floor 23, which is a portion of the wall or mullion 5 that separates the freezer compartment 11 from the fresh-food compartment 7. The floor 23 may also include inlet openings 25 that may serve as air ducts that direct return air from the fresh-food compartment 7 to the freezer compartment 11 above. Air that has circulated through the fresh-food compartment 7 may return to the freezer 11 through the inlet openings 25. The floor 23 may also include an exhaust opening 27. The exhaust opening 27 serves as a cooling air channel 27 in the floor through which cold air (i.e., supply air) from the freezer compartment 11 is directed to the fresh-food compartment 7. The cooling air channel 27 can be controlled by a baffle 30 to an open position and to a closed position. Also, the baffle 30 may in some embodiments be controlled to a position between the open position and the closed position. The baffle 30 can in accordance with some embodiments be controlled manually.

The upper side portions of the air tower 21 may be provided with air openings, such as air ports 29' and 29", for example. The air ports 29' and 29" allow the cool air from the fresh-food compartment 7 that passes upwardly through the air tower 21 to be discharged via the air ports 29' and 29" into the interior of the freezer compartment 11. The air ports 29' and 29" may be formed on each side portions of the air tower 21, and may be positioned or oriented variously as desired to direct the cool air towards certain parts of the freezer compartment 11. Any number of air ports 29' and 29" may be provided on each of the side portions of the air tower 21 in various shapes and sizes. For example, the upper air ports 29' and 29" can have larger cross-sectional dimensions than the middle and lower air ports 29' and 29" to balance out the air flow distribution and provide uniform cooling in the freezer compartment 11, since the upper air ports 29' and 29" are located furthest from the inlet at the lower portion of the air tower 21. In this manner, for a given air flow rate or pressure through the air tower 21, relatively the same amount or rate of airflow will be discharged out of the various air ports 29' and 29".

Figure 3:
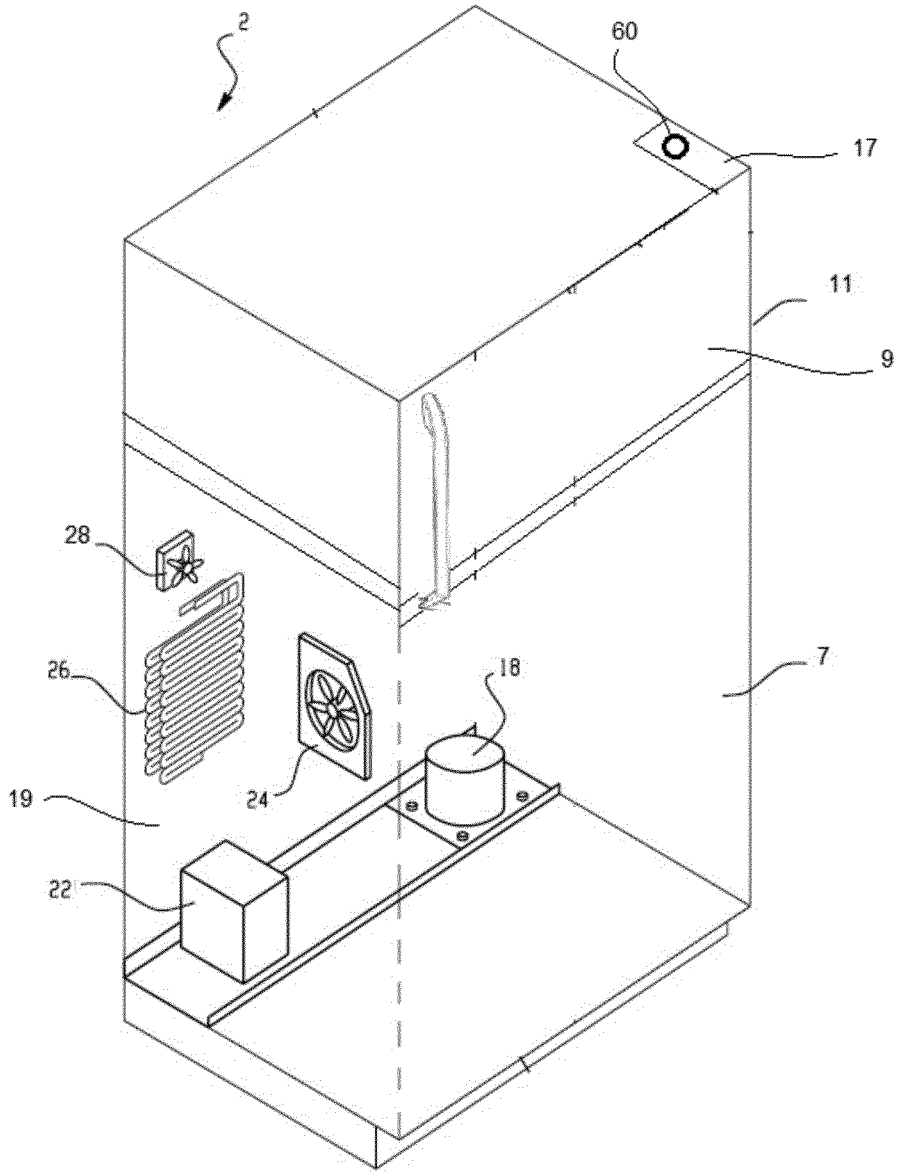
FIG. 3 illustrates an example cooling/refrigeration system of a refrigerator.

FIG. 3 illustrates an example cooling/refrigeration system of the refrigerator 2 includes a machine compartment 19 housing the refrigeration components, such as a variable speed compressor 18, a condenser 22 connected to the compressor 18, a condenser fan 24, an evaporator 26 connected in series and charged with a refrigerant, and a variable speed evaporator fan 28. The variable speed evaporator fan 28 circulates cooling air through the refrigerator compartments and improves heat transfer efficiency. The condenser 22 expels heat withdrawn by the evaporator 26 from the fresh-food compartment 7 and the freezer compartment 11, respectively. The variable speed compressor 18 and or the evaporator fan and potentially also other devices of the refrigerator 2 can be controlled by a controller 60. The refrigeration appliance thus can control the temperature in the compartments of a refrigerator appliance by cooling by a refrigeration circuit comprising, a compressor, in particular a variable speed compressor, an evaporator, and a variable speed evaporator fan.

The controller can be configured to control the refrigerator 2 in, at least, two different modes. The at least two different modes of operation can comprise a normal mode of operation and a freezer priority mode. In the freezer priority mode cooling capacity is directed to the freezer compartment to increase the freezing capacity of the freezer compartment. This is typically advantageous when placing relatively warm items in the freezer compartment to freeze the item. For example, when placing unfrozen goods in the freezer compartment it is often beneficial to quickly freeze the un-frozen goods. In accordance with some embodiments the controller is configured to reduces the evaporator fan speed according to the refrigerator compartment temperature (directly proportional to the difference between measured and set point temperatures). This control can be carried out by any standard industry control strategy, even a simple proportional control can be used. However, a Proportional Integral (PI), Proportional Integral Derivative (PID), Fuzzy logic or any modern control algorithms can also be used. The controller can also be configured to control the variable speed compressor where the controller is configured to, in a normal mode of operation, operate the variable speed compressor at a first calculated compressor speed and in a freezer priority, mode of operation, operate the variable speed compressor at a second calculated compressor speed where the second calculated compressor speed is higher than the first calculated compressor speed.

Switching between the normal mode of operation and the freezer priority mode can be performed manually using a control button such as a switch or the like. In the alternative, the freezer priority mode can be a subroutine called by any function of a control algorithm run by the controller, for instance, a warm product start up (pulldown), door opening or load detection routines.

When operating in the freezer priority mode, the evaporator fan and/or the variable compressor fan is operated differently than in the normal mode of operation as described above. Hereby, more cooling capacity can be directed to the freezer compartment. This will reduce the time for freezing items/goods placed in the freezer compartment. The freezer priority mode is enabled until some exit condition is met. For example, a user can manually turn off the freezer priority mode. In accordance with one embodiment, a defrost evaporator temperature sensor can be provided. The controller 60 can then be configured to automatically exit the freezer priority mode when the defrost evaporator temperature sensor indicates a temperature below a pre-set temperature. In accordance with some embodiments a timer can be provided and the controller can be configured to automatically exit the freezer priority mode when the timer indicates that the freezer priority mode has been operational for a pre-set time. Also, in case the freezer priority mode is called by some other control algorithm subroutine, the subroutine can have its own criteria to termination (for instance, time, temperature, power, temperature gradients)

When the priority freezer mode is exited, the controller can be configured to return to the normal mode of operation where the refrigeration is controlled in accordance with a control algorithm for normal operation of the refrigerator. This normal mode of operation can typically be any pre-existing control algorithm for control of a refrigerator of the kind described herein.

In accordance with some exemplary embodiments, the evaporator fan speed is controlled to keep the temperature of the Fresh Food compartment at the temperature set point (closer to the temperature set point). For example, when the temperature set point is set to a value during normal mode of operation such as e.g. 6° C. the temperature is allowed to vary within some range around the temperature set point, for instance, within ±1° C. In such situation, the controller calculates the compressor and fan speeds to ensure a normal cooling capacity distribution among the compartments When in the priority freezer mode, the evaporator fan is controlled to let the temperature aim and stay at the set point temperature as much as possible. This change in control behavior allows more cooling capacity to be delivered to the freezer.

In accordance with some embodiments the evaporator fan speed can calculated through a, Proportional, Integral and derivative, PID, control algorithm based on the Fresh Food temperature error defined as the difference between Fresh Food temperature sensor and the temperature set point in the freezer priority mode. This allows the fresh food temperature to be stable at the set point during the Freezer priority mode For example, a pulse width modulated (PWM) evaporator fan speed signal fan PWM can be set in accordance with $$Fan_{PWM} = Fan_P + Fan_I - Fan_D$$

$$T_{Err_{FF}} = T_{measured_{FF}} - T_{set_{FF}}$$

$$Fan_P = Kp_{Fan} * T_{Err_{FF}}$$

$$Fan_I = \frac{Kp_{Fan}}{Ti_{Fan}} * Integral_{T_{Err_{FF}}}$$

$$Fan_D = Kp_{Fan} * Td_{Fan} * Derivative_{T_{measured_{FF}}}$$

Where $T_{ErrFF}$ is the measured temperature minus the set temperature (setpoint temperature), the $Integral_{ErrorFF}$ is the time integration of the temperature error $T_{ErrFF}$ and the $Derivative_{TmeasuredFF}$ is the time derivative of the $T_{measuredFF}$ The Kp, Ti and Td are the PID parameters (usually constants).

The Integral and/or Derivative parameters can be set to zero, making the control a P (both set to Zero), PD (Integral is set to Zero) or PI (Derivative is set to Zero).

Figure 4:
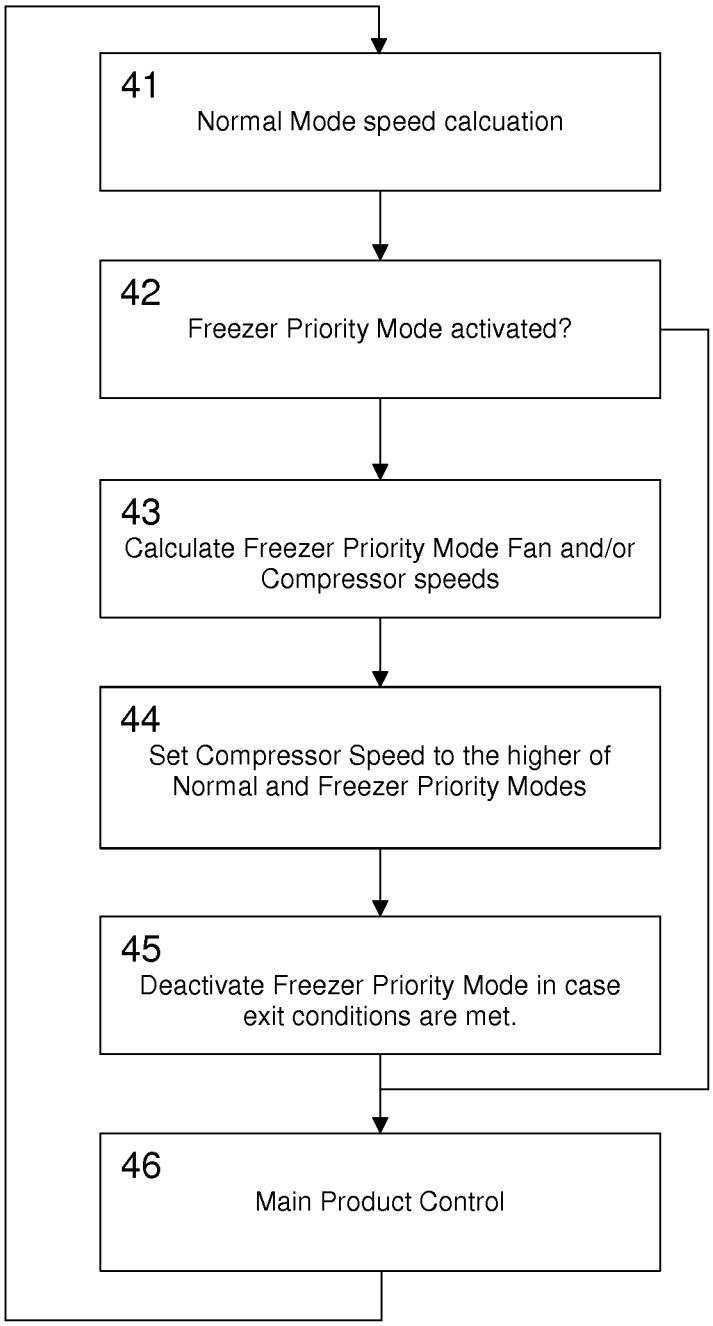
FIG. 4 is a flowchart illustrating some steps performed by a controller when controlling the cooling/refrigeration system.

FIG. 4 is a flowchart illustrating some steps that can be performed by the controller 60 when controlling the refrigeration appliance in accordance with the teachings herein. First, in a step 41 the controller 60 is set to control the refrigeration appliance in accordance with a first control algorithm. This first control algorithm can be referred to as a normal mode of operation and can be in accordance with any control algorithm used for controlling a refrigeration appliance with at least one freezer compartment and one fresh food compartment. Next, in a step 42, a priority freezer mode is activated, the priority freezer mode is a second mode of operation that controls the refrigeration appliance in accordance with another control algorithm than the control algorithm used in the normal mode of operation. In particular the control of the speed of a VSC and/or the control of the evaporator fan speed can be controlled differently from the normal mode of operation. The priority freezer mode can be activated based on some pre-determined condition or can be activated manually. When in the priority freezer mode new speeds for the compressor and or evaporator fan are calculated in a step 43. The calculated new speeds for the compressor and or evaporator fan speed are then applied. In accordance with some embodiment the compressor speed can be set to the highest of the compressor speeds calculated for the normal mode of operation and the freeze priority mode in a step 44. Next, in a step 45, the controller checks for an exit condition to leave the priority freezer mode. The exit condition can be any pre-set condition such as the ones described hereinabove, or the exit condition can be a manually entered command to exit the priority freezer mode. If the condition to exit is met in step 45, the priority freezer mode is exit and the controller starts to control the refrigeration appliance in accordance with another control algorithm in a step 46. In accordance with one embodiment the control algorithm applied in step 46 is the control algorithm used for the normal mode of operation, but another, third, control algorithm can also be used.

The invention claimed is:

1. A refrigeration appliance, comprising:

a fresh-food compartment configured for storing food items at a first target temperature above zero degrees Celsius;

a freezer compartment configured for storing food items at a second target temperature below zero degrees Celsius;

a cooling air channel formed between the freezer compartment and the fresh-food compartment a refrigeration circuit configured for cooling the freezer compartment, the circuit having a variable speed compressor, an evaporator, and a variable speed evaporator fan; and a controller operatively connected to the refrigeration circuit and configured to:

operate the variable speed compressor and the variable speed evaporator fan at a calculated speed of the variable speed compressor and a calculated speed of the variable speed evaporator fan, respectively; wherein the controller is configured to, in a normal mode of operation, operate the variable speed compressor at a normal calculated compressor speed and the variable speed evaporator fan at a normal calculated fan speed and wherein the controller is configured to, in a freezer priority mode of operation, operate the variable speed compressor at a higher calculated compressor speed than the normal calculated compressor speed and the variable speed evaporator fan at a lower calculated fan speed than the normal calculated fan speed.

2. The refrigeration appliance according to claim 1, comprising a manually operated control button configured to switch between the controller to operating in said normal mode of operation and said freezer priority mode of operation.

3. The refrigeration appliance according to claim 1, comprising a manually operated baffle in said cooling air channel.

4. The refrigeration appliance according to claim 1, comprising a defrost evaporator temperature sensor, and wherein the controller is configured to automatically exit the freezer priority mode when the defrost evaporator temperature sensor indicates a temperature below a pre-set temperature.

5. The refrigeration appliance according to claim 1, comprising a timer and wherein the controller is configured to automatically exit the freezer priority mode when the timer indicates that the freezer priority mode has been operational for a pre-set time.

6. The refrigeration appliance according to claim 1, wherein the controller is configured to upon exiting the freezer priority mode of operation return to the normal mode of operation.

7. The refrigeration appliance according to claim 1, where, in the freezer priority mode, the evaporator fan speed is controlled to keep the temperature of the Fresh Food compartment closer to a temperature set point than in the normal mode of operation.

8. The refrigeration appliance according to claim 1, where, in the freezer priority mode, the evaporator fan speed is calculated through a, Proportional, Integral and derivative, PID, control algorithm based on the temperature error defined as the difference between Fresh Food temperature sensor and the temperature set point.

9. The refrigeration appliance according to claim 1, where, in the freezer priority mode, the minimum variable speed compressor is set to a pre-determined value.

10. The refrigeration appliance according to claim 1 where the compressor speed is configured to be set to the maximum speed between the compressor speed determined by the normal mode and the Freezer Priority pre-determined value.

11. The refrigeration appliance according to claim 1 where, in the freezer priority mode, the set point temperature of the fresh food compartment is configured to be set to a lower temperature than in the normal mode of operation.

* * * * *